US005368920A

United States Patent [19]

Schortmann

[11] Patent Number: 5,368,920

[45] Date of Patent: Nov. 29, 1994

[54] NONPOROUS BREATHABLE BARRIER FABRICS AND RELATED METHODS OF MANUFACTURE

[75] Inventor: Walter E. Schortmann, Cumberland, R.I.

[73] Assignee: International Paper Company, Purchase, N.Y.

[21] Appl. No.: 74,195

[22] Filed: Jun. 9, 1993

Related U.S. Application Data

[63] Continuation of Ser. No. 777,891, Oct. 16, 1991, abandoned.

[51] Int. Cl.[5] ..... B32B 5/16; D04H 1/58

[52] U.S. Cl. ..... 428/224; 428/283; 428/288; 428/289

[58] Field of Search ..... 428/236, 237, 245, 260, 428/263, 283, 290, 296, 297, 284, 286, 288, 298, 299, 289

[56] References Cited

U.S. PATENT DOCUMENTS

| | | | |
|---|---|---|---|
| 3,042,573 | 4/1962 | Roberts | 156/285 |
| 3,310,459 | 3/1967 | Guthrie | 162/12 |
| 3,507,675 | 4/1970 | Noda et al. | 117/11 |
| 3,544,357 | 12/1970 | Noda et al. | 117/63 |
| 3,554,789 | 1/1971 | Kigane | 117/161 |
| 4,196,245 | 4/1980 | Kitson et al. | 428/198 |
| 4,308,303 | 12/1981 | Mastroianni et al. | 428/90 |
| 4,353,945 | 10/1982 | Sampson | 428/90 |
| 4,433,026 | 2/1984 | Molde | 428/252 |
| 4,454,191 | 6/1984 | Von Blucher et al. | 428/244 |
| 4,499,139 | 2/1985 | Schortmann | 428/245 |
| 4,537,817 | 8/1985 | Guillaume | 428/260 |
| 4,539,255 | 9/1985 | Sato et al. | 428/252 |
| 4,554,198 | 11/1985 | Von Blucher et al. | 428/143 |
| 4,613,544 | 9/1986 | Burleigh | 428/315.5 |
| 4,630,603 | 12/1986 | Greenway | 128/156 |
| 4,671,266 | 6/1987 | Lengyel et al. | 128/156 |
| 4,707,400 | 11/1987 | Towery | 428/260 |
| 4,736,467 | 4/1988 | Schwartze et al. | 2/114 |
| 4,761,326 | 8/1988 | Barnes et al. | 428/219 |
| 4,818,600 | 4/1989 | Braun | 428/290 |

FOREIGN PATENT DOCUMENTS

| | | | |
|---|---|---|---|
| 2087262 | 5/1982 | United Kingdom | D06N 7/02 |

*Primary Examiner*—Jenna L. Davis
*Assistant Examiner*—Kathryne E. Shelborne
*Attorney, Agent, or Firm*—Dara L. Onofrio

[57] ABSTRACT

Breathable barrier fabrics are made by sizing a substrate, made of bonded fibers forming void spaces therein, with a film-forming material that fills the voids of the substrate to form a solid film between the fibers. The resulting non-porous breathable material provides a high strength fabric which is permeable to water vapor, such as body moisture, but impermeable to air and aqueous liquids. The non-porous breathable barrier fabric acts as a barrier against wind, dust or other airborne contaminants, e.g. bacteria, viruses, pesticides, etc., as well as against aqueous liquids such as blood. Alternatively, porous barrier fabrics can be made by incorporating air into the film-forming filler material to obtain greater comfort at lowered barrier qualities. The barrier fabrics of the invention are suitable for industrial, hospital and other protective covering uses.

14 Claims, 5 Drawing Sheets

NONPOROUS BREATHABLE BARRIER FABRICS AND RELATED METHODS OF MANUFACTURE

This application is a continuation of application Ser. No. 07/777,891, filed Oct. 16, 1991, now abandoned.

FIELD OF INVENTION

This invention generally relates to breathable barrier fabrics and a related methods of making the same. In particular, the invention relates to nonporous barrier fabrics comprised of a nonwoven, or woven material sized by a film forming filler material which provides a fabric that is permeable by water vapor, but impermeable by aqueous liquids and air.

BACKGROUND ART

Barrier fabrics have diverse applications as protective industrial outerwear, lab coats, hospital gowns, drapes, household wraps, bandages, and other waterproofing materials. For such applications it is advantageous to provide a strong, breathable, drapable and hydrophobic fabric.

Numerous prior art patents disclose various textile materials which are impermeable to water and aqueous liquids but are permeable to air and moisture vapor. In general, the moisture permeable fabrics are porous structures coated with plastic film layers such as polyurethane, see U.S. Pat. No. 4,554,198 to von Blucher and U.S. Pat. No. 4,539,255 to Sato. Alternatively, waterproof fabrics, permeable to moisture, are also provided by coating a porous textile substrate with coagulated elastomers, typically long polymer chains or synthetic resins, see U.S. Pat. No. 4,537,817 to Guillaume.

U.S. Pat. No. 4,499,139 to Schortmann, discloses a porous barrier fabric comprised of plastic films having micropores formed by froth bubbles. The fabric is formed by microsizing a single ply hydroentangled nonwoven fibrous web with an aerated latex froth. Microsizing is defined in the Schortmann '139 specification "as the application of a latex froth to a fabric to create microsize pores, which are necessary to establish a bacterial barrier in a fabric while preserving air permeability". The barrier fabric structure has sufficient hydrophobicity to be a bacterial barrier while maintaining comfort, drapeability, air permeability, and flexibility.

The prior art has thus provided porous materials which are permeable to moisture vapor and impermeable to water and aqueous liquids. However, these materials are not suitable as barriers to air. There is a need in the art for a nonporous barrier fabric which is permeable to moisture but impermeable to air as well as to aqueous liquids.

Accordingly, it is a broad object of the invention to provide a nonporous barrier fabric comprised of a substrate sized with a film forming filler material, which is permeable to water vapor but acts as a barrier against airborne or aqueous transported contaminants, e.g. bacteria, viruses or blood.

A more specific object of the invention is to provide a method for producing breathable barrier fabrics which are less complex to manufacture and have improved properties over the prior art.

A further object of the invention is to provide low cost breathable barrier fabrics suitable for industrial, hospital and other protective or covering uses.

DISCLOSURE OF INVENTION

In the present invention, these purposes, as well as others which will be apparent, are achieved generally by providing breathable barrier fabrics permeable to water vapor and impermeable to aqueous liquids and air, which are made of a substrate sized on one or both Sides, or totally throughout the structure, with an aqueous film-forming filler material. According to the invention, the aqueous slurry is sized into at least one surface of the substrate made of bonded fibers which form void spaces therein. The slurry fills the void spaces and is dried on the fabric to form a continuous film of filled polymer in between the fibers to form a nonporous but breathable barrier fabric. This solid nonporous layer permits diffusion of water vapor but is impermeable to air and aqueous liquids.

The film-forming filler material is selected from the group consisting of film-forming latexes and clays. Water vapor is transpired by transport through the clay-filled polymer film with the transpiration rate increasing with skin temperature to regulate body temperature. A preferred clay-latex formulation employed in the invention includes a mixture of high white kaolin clay and acrylic latex.

Substrates employed in the invention consist of woven or nonwoven fabrics of open structure, having bonded fibers forming void spaces therein. The void spaces of the substrate are equivalent to the interstitial bond distances between the bonded fibers and are in the range of 0.05 mm to 0.4 mm. Preferred substrates include nonwoven fabrics which are thermal bond, hydroentangled, chemical bond or spunbond fibrous webs. Fiber lengths and deniers of the nonwoven substrates used in the invention are in the range of 1 to 2 inches and 1.0 to 3.0, respectively.

In another embodiment air is dispersed in the aqueous slurry which is then applied to the substrate to fill the void spaces. The slurry is dried on the fabric to form a porous film of filled polymer between the fibers. Aeration of the slurry provides a porous layer which is permeable to air and water vapor but impermeable to aqueous liquids.

Other objects, features, and advantages of the present invention will become apparent from the following detailed description of the best mode of practicing the invention when considered with reference to the drawings, as follows:

DETAILED DESCRIPTION OF THE PREFERRED EMBODIMENT

Figure 2:
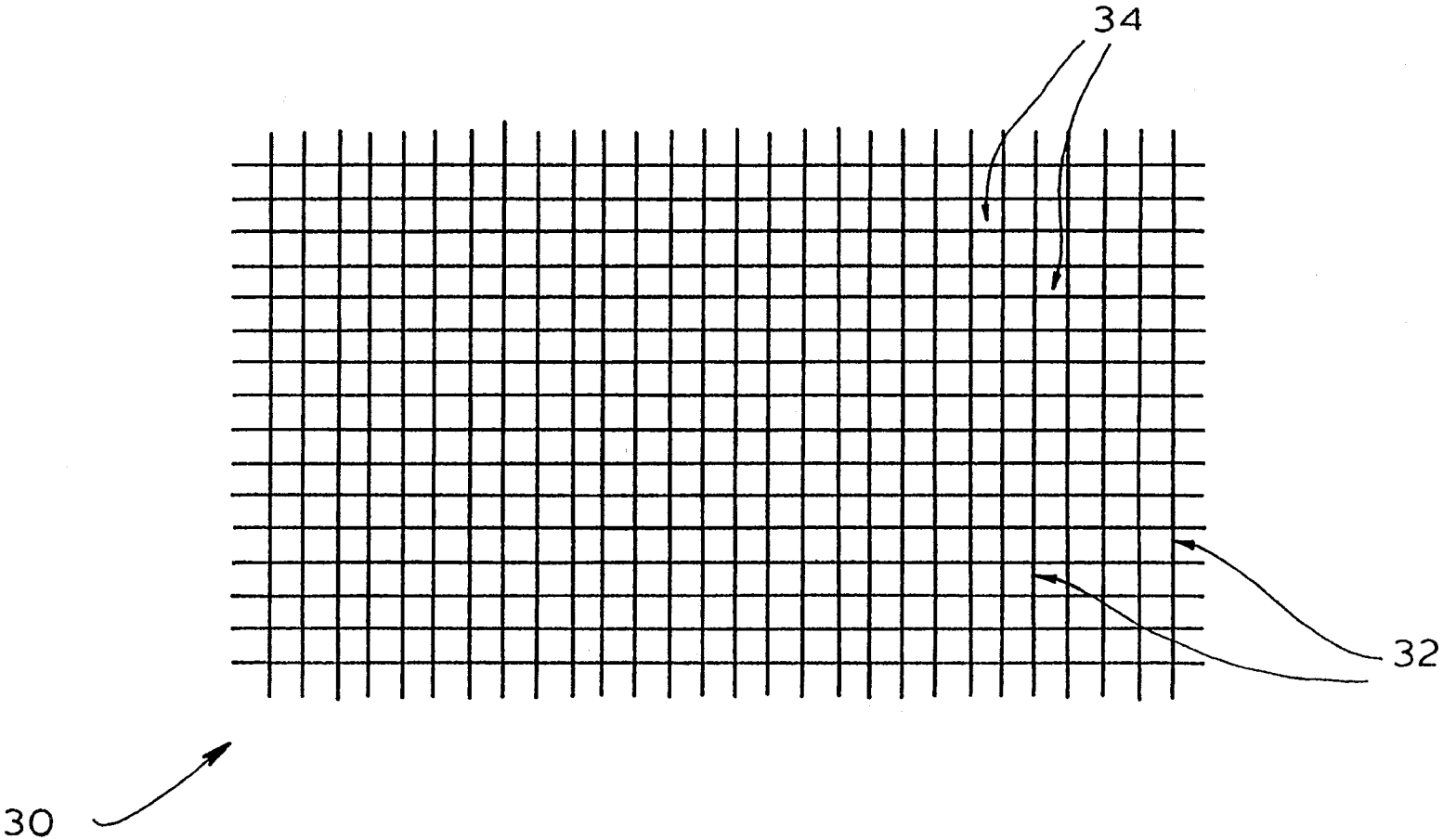
FIG. 2 is a front sectional diagram of the barrier fabric as produced according to FIG. 1.

In accordance with the invention as shown in FIG. 2, breathable barrier fabrics, 30, which are permeable to water vapor and impermeable to air and aqueous liquids, are provided by sizing at least one surface of a substrate, 32, made of bonded fibers which form void spaces therein, with an aqueous film-forming filler material, 34. The film-forming filler material is sized into at least one surface of the substrate and dried to form a continuous film of filled polymer in between the fibers to form a nonporous but breathable barrier fabric. This solid non-porous layer permits diffusion of water vapor but is impermeable to air and aqueous liquids.

In another embodiment air is dispersed in the film-forming filler material and is sized into at least one surface of the substrate to form a porous film of filled polymer between the fibers. Aeration of the film-forming filler material provides a porous layer which permits diffusion of water vapor and air but remains impermeable to aqueous liquids.

In this specification permeability to water vapor is determined by the Moisture Vapor Transmission Rate (MVTR). The MVTR measurements are conducted according to Standard Test Methods for Water Vapor Transmission of Materials as disclosed in American Society of Testing Materials, ASTM E96-80. Moisture vapor includes body moisture and humidity.

Air permeability of the barrier fabrics of the invention is based on the Frazier Air Permeability (FAP) values. The Frazier Air Permeability (FAP) is an air permeability measurement conducted according to the Industrial Nonwoven Disposable Association Standard Test IST 70.1-70(R77) and Federal method 5452 referred to as the Frazier Test. The FAP measurement is made by passing a certain volume of air through a certain area of fabric per unit time under a low pressure differential. Thus the greater the volume of air passed through a fabric the higher the air permeability.

Impermeability of the barrier fabrics of the invention to aqueous liquids is determined using the Hydrostatic Head Test. The Hydrostatic Head Test is conducted according to the American Association of Textile Chemists and Colorists AATCC-127-1974 and Industrial Non-woven and Disposable Association (INDA) Standard Test IST 80.0-70(R77). The Hydrostatic Head Test is conducted to determine the amount of water pressure the fabric can withstand before water passes through said fabric. INDA defines a "liquid proof" fabric as one that possesses a hydrostatic head of 60 cm (23.6 inches) or more.

Figure 1:
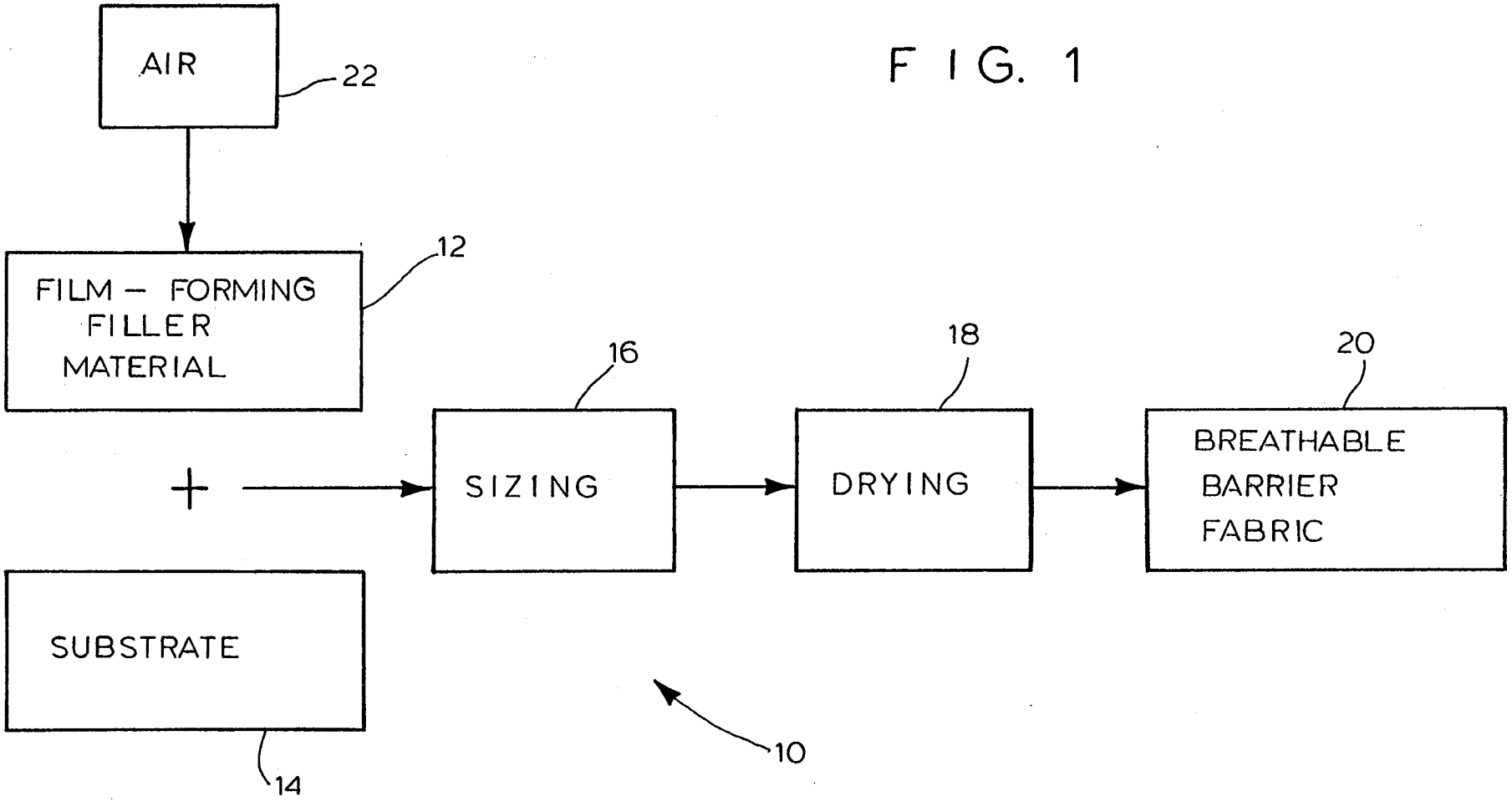
FIG. 1 is a schematic diagram of the production steps for making a barrier fabric in accordance with the invention.

FIG. 1 is a schematic diagram of the production steps for making breathable barrier fabrics in accordance with the invention process 10. In general, a nonporous breathable barrier fabric is formed by the process of forming an aqueous slurry of a film-forming filler material 12, and applying it to a substrate 14, made of bonded fibers which form void spaces therein. The slurry fills the void spaces of the substrate to form a continuous film of filled polymer between the fibers 16. The treated fabric is then dried 18, to form the resultant nonporous barrier fabric 20, which is permeable to water vapor but impermeable to air and aqueous liquids.

Preferably the slurry is dried within the fabric at a temperature in the range of 350° to 400° F. at 50 feet/-min.

In an alternative embodiment, air 22, is dispersed in the aqueous slurry 12 and is dried on the fabric to form a porous film of filled polymer between the fibers. This porous layer is permeable to air and water vapor but impermeable to aqueous liquids.

Substrates used in the invention consist of woven or nonwoven fabrics of open structure, having bonded fibers forming void spaces therein. These substrates are used to form barrier fabrics with good tear strength, low cost and improved drape and hand. Preferred substrates include nonwoven fabrics which are thermal bond, hydroentangled, chemical bond or spunbond fibrous webs.

The void spaces of the substrate are equivalent to the interstitial bond distances between the bonded fibers and are in the range of 0.05 mm to 0.4 mm. Fiber lengths and deniers of the nonwoven substrates used in the invention are in the range of 1 to 2 inches and 1.0 to 3.0, respectively. Table I below lists typical characteristics of the nonwoven fabrics used in the invention. Woven fabrics having similar void space dimensions may also be employed.

TABLE I

TYPES OF NONWOVENS USED

| NONWOVEN | BOND DISTANCE (mm) | FIBER LENGTH (inches) | DENIER | WEIGHT (gsy) | FAP ($ft^3/ft^2/min.$) |
|---|---|---|---|---|---|
| Hydroentangeled mesh of 100 × 94 | 0.06 | 1.5 | 1.5 | 40 | 460 |
| Thermal bond | 0.09 | 1.5 | 1.5 | 28 | 300 |
| Spunbond | 0.38 | Continuous | — | 23 | 850 |
| Spunbond | 0.09 | Continuous | — | 36 | 300–500 |

The film-forming filler material is selected from the group consisting of film-forming latexes and clays. Preferred latexes used include 40-434-00 51% latex manufactured by Reichhold Chemical, Inc., P.O. Drawer K, Dover, Del. 19903, and latex 4445 manufactured by National Starch, Finderne Avenue, Bridgewater, N.J. 08807, and preferred clay materials include Hi-White Kaolin clay manufactured by J. M. Huber Corporation, P.O. Box 310, Havie de Grace, Md., 21078 and sold by Monson Chemical, Lovezzolla Ward Division, 154 Pioneer Drive, Leominster, Mass., 01453. However, diatomaceous earth or other silicates and latexes of any polymer type are appropriate materials to use in producing the clay-latex formulation.

Preferably, the film-forming filler material is a viscous, aqueous clay-latex formulation having a density of 1500 gram per liter. The density of the film-forming filler material varies according to the percentage of clay present in the formulation.

In a preferred embodiment, the clay-latex formulation consists of a mixture of Hi-White R Kaolin clay, 1% RU sodium silicate 52° Be, water and 51% solid latex, (See Example III). In another alternative embodiment-, the clay-latex formulation consists of a mixture of Hi-White R Kaolin clay, 1% RU sodium silicate 52° Be, water, National Starch NS6272, Polystep F-9, Graphtol Blue Pigment 6825-2, Black Shield Color CD1103-96, Ammonium Stearate, Fluorocarbon FC824, siligen APE and Aerotex 96B, (See Example IX).

The slurry of film-forming filler material can be sized into both surfaces of the substrate or totally throughout the structure of the substrate surface using a double blade S-wrap applicator. When the aqueous slurry of the film-forming filler material is applied to the substrate, the slurry fills the interstitial voids of the substrate to form a solid non-porous layer that permits diffusion of water vapor when a driving force of a concentration gradient exists, such as from high humidity to lower humidity.

The process of forming a solid film between the fibers is advantageous over the prior art processes for barrier fabrics using sizes or coatings of foams or froths within the fiber structure to obtain micropores.

U.S. Pat. No. 4,499,139 to Schortmann discloses production of barrier fabrics using froths to form micropores. As defined in the specification, froths are air bubbles that form micropores within a clay-latex structure. The microsizing froths shown in Schortmann '139 are specified to be between 100 to 300 grams per liter and are nonpourable.

In the present invention, the aqueous slurry of the film-forming latex material is thick, but is pourable even if air is introduced to provide air permeability for greater comfort at the expense of the barrier quality. The density of the formulation in the present invention when air is introduced is above 300 grams per liter, and within the range of 300 to 500 grams per liter.

Advantageously, unlike the froths, the nonporous barrier fabric of the invention breathes by providing permeability to moisture transport through the clay-latex film between the fabric's fibers, but acts as a barrier to air and aqueous liquids. Water vapor is transpired through the clay-latex filler film.

Importantly, the transpiration rate increases with skin temperature, thereby greater evaporative cooling is achieved when most needed. Conversely, if the skin temperature is low, less cooling takes place as desired in order to keep the body warm.

The following examples I through X below, show various types, characteristics and methods of producing the breathable barrier fabrics of the invention. These examples are merely representative and are not inclusive of all the possible embodiments of the invention.

In general, Example I shows the process of producing a breathable barrier fabric of the invention which is permeable to water vapor but impermeable to air and aqueous liquids. Example II shows the use of various substrate materials employed in the process of the invention. Example III shows the effect of clay content on the breathability of the resulting barrier fabric. Example IV shows an alternative embodiment of the invention in which the substrate is sized on both sides with the film-forming filler material. Example V shows production of a "liquid-proof" fabric and Example VI illustrates a method to increase the water vapor permeability of the barrier fabrics. Example VII discloses a production line for making a preferred embodiment of the invention. Example VIII shows the effects of temperature on the moisture vapor transmission rate of the resulting barrier fabrics. Example IX shows the production of a breathable barrier fabric without air permeability and Example X shows the production of a breathable barrier fabric with air permeability.

EXAMPLE I

In this example, a breathable barrier fabric which is permeable to water vapor but impermeable to aqueous liquids and air is produced in accordance with the process of the invention.

A clay dispersion was made by high sheer mixing of Hi-white R kaolin clay from Lovezzola Ward Co., 154 Pioneer Drive, Leominster, Mass., 01453, into water containing 1% RU sodium silicate 52° Be from the P.Q. Corp., Valley Forge Executive Mall, P.O. Box 840, Valley Forge, Pa. 19482-0840, until 65 to 67 weight percent of clay was reached. The density of the clay dispersion was approximately 1500 grams per liter.

The film-forming filler material was prepared using 120.2 grams of this clay dispersion, 15 grams of tap water and 150 grams of 40-434-00 51% solids latex manufactured by Reichhold Chemical, Inc. The clay-latex formulation, having a viscosity of 5,300 centipoise (c.p.) and density of 1,270 gm/liter, was stirred with a spatula and then applied via a hand-held sizing blade to a piece of hydroentangled 100% polyester web of closed, 100×94, weave. The hydroentangled web had been pre-treated with a fluorocarbon solution of 13.5% of 100% active Siligen APE anti-stat imported by BASF, 100 Cherry Hill Road, Parsippany, N.J., from BASF, Germany, 43.8% of Aerotex 96B of 25% solids manufactured by American Cyanamid, Bound Brook, N.J., 08809, and 42.7% of FC824 fluorocarbon of 40% solids manufactured by 3M's, Commercial Chemicals Division, 223-63E, 3M Center, St. Paul, Minn. 55144. Approximately one gram per square yard of the solution had been added to the hydroentangled web. Pre-treatment of the web with this fluorocarbon solution increases water repellency of the resulting fabric.

After sizing the hydroentangled web with the clay-latex formulation the finished sample weighed 85.5 grams. The Frazier Air Permeability (FAP) was zero at a section of 92.5 gsy where the Moisture Vapor Transmission Rate (MVTR) at 86° F. was 1500 gm/m$^2$/day. The hydrostatic head was 14 inches. The MVTR chamber was at 50% relative humidity and 72° F.

The temperature for the MVTR was chosen since it is about the temperature of the space between a body and indoor protective garment. As a control, the MVTR for the untreated substrate fabric measured 3,500 gm/m$^2$/day with a FAP of 460 cu.ft./sq.ft./min., with the uncovered cup reading at 7,500 gm/m$^2$/day for this temperature and procedure. The uncovered cup reading indicates the MVTR, or maximum evaporation rate, for no fabric at all. This illustrates that the untreated substrate fabric has a MVTR approximately one-half that of no fabric at all.

Figure 3:
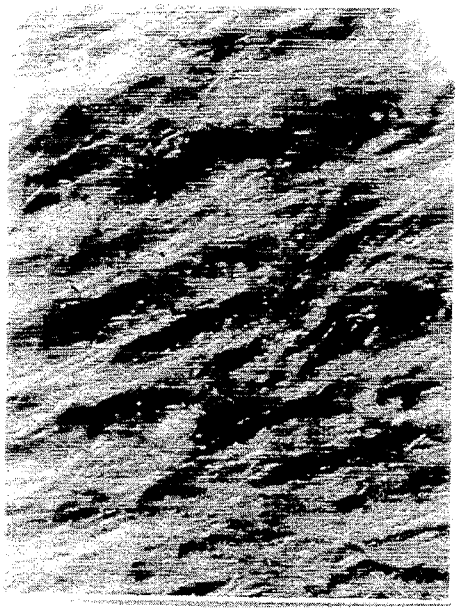
FIG. 3 is a photomicrograph at 11×of a nonporous barrier fabric made with a hydroentangled substrate in accordance with Example I.

U.S. Pat. No. 4,308,303 to Mastroianni et al. discloses a flocked, foam-coated fibrous reinforced, water vapor permeable bacterial barrier. As stated in Mastroianni et al. the human body perspires between 60 to 100 gm/100 in$^2$/24 hrs., or approximately 1,560 gm/m$^2$/day, under usual conditions and exertion. Thus, the barrier fabric of Example I with a MVTR of 1500 gm/m$^2$/day provides effective breathable properties for use in a protective garment fabric. In FIG. 3, a photomicrograph of Example I at 11×, the dense solid nature of the fabric's surface as well as its fibrous character is shown.

EXAMPLE II

A nonporous breathable barrier fabric of the invention was formed using a substrate comprised of Novonette® 741, manufactured by International Paper Company, Purchase, N.Y., sized with the clay-latex formulation as disclosed in Example I.

The Novonette® 741 substrate, made at 35 gsy from two denier polypropylene fibers, was pre-treated by the same fluorocarbon solution as in Example I.

The clay-latex formulation was prepared using 121 grams of the clay dispersion as prepared in Example I, 15 grams of tap water and 150 grams of 40-434-00 51% solids latex manufactured by Reichhold Chemical Inc. This formulation was applied by standard bench-top drawdown procedures to the Novonette®. The sample had a total weight of 81.5 gsy. The air permeability of the sample was determined by FAP and Gurley Air Permeability standard test measurements. The FAP was zero and the Gurley air permeability (heavy cylinder 4.88 inches of water pressure) was 1308 sec., which is virtually no air flow. The hydrostatic head was 16 inches.

Figure 4:
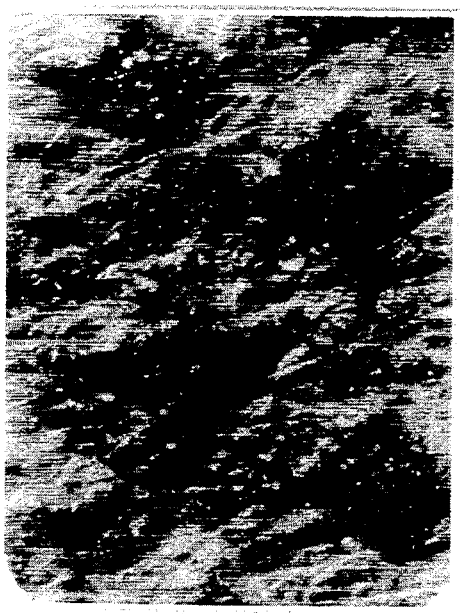
FIG. 4 is a photomicrograph at 11×of a nonporous barrier fabric made with a Novonette® substrate in accordance with Example II.

A section of the sample at 77 gsy showed a MVTR at 84° F. to be 1600 gm/m$^2$/day. FIG. 4 is a photomicrograph of Example II at 11×, which shows the dense solid nature of the fabric surface as well as its fibrous characteristics. FIG. 4 shows the same structure as Example I illustrated in FIG. 3.

EXAMPLE III

Samples were prepared to show the effect of the clay content on the breathability of the barrier fabrics of the invention.

Neat (undiluted) 40-434-00 51% solids latex, manufactured by Reichhold Chemical Inc., was applied to a substrate comprised of a 20 gsy Novonette® fibrous web made from 1.5 d, 1.5 inch polypropylene fibers. The resulting product was very soft with excellent drape properties, and even though no clay was included in the formulation the surface was not tacky. The MVTR at 86° F. was 700 gm/m$^2$/day for a 68 gsy product that had a FAP value of zero.

A clay-latex formulation was prepared using 52 grams of the clay dispersion of Example I and adding 14 grams of water and 140 grams of Reichhold 40-434-00 51% solids latex. The resulting compound which had 43 parts per hundred (PHR) of clay was applied to the same substrate as above. The MVTR at 84° F. of this product was 1100 gm/m$^2$/day.

Another sample using the same materials was produced, having 100 PHR of clay and yielded an MVTR at 84° F. of 2000 gm/m$^2$/day for a product weighing 76 gsy that had a FAP value of zero. Table II below, shows the results of the effect of clay content on the breathability of the resulting barrier fabrics.

TABLE II

| EFFECT OF CLAY CONTENT ON BREATHABILITY | |
|---|---|
| CLAY CONTENT, PHR | MVTR, gm/m$^2$/day |
| 0 | 700 |
| 43 | 1100 |
| 100 | 2000 |

EXAMPLE IV

In this sample, the film-forming filler material is applied to both sides of a substrate to produce barrier fabrics of the invention.

A wind-proof, but breathable and strong, barrier fabric, for possible use as a housewrap, was prepared by using a clay-latex formulation made of a mixture of 119.2 grams of the clay dispersion of Example I, 35.5 grams of water and 147.5 grams of Reichhold's 40-434-00 51% solids latex. This diluted formulation was applied to a 34 gsy polyester spunbond Lutrasil® LD 7225 white fibrous web manufactured by Freudenburg Spunweb, P.O. Box 15910, Industrial Drive, Durham, N.C. 27704, by a double-knife process, called 3F (Fully Filled Fabric).

Addition of 20 gsy of this clay-latex formulation reduced the high air permeability of the fabric from 800–900 cu. ft./sq. ft./min. to zero. The hydrostatic head was 12.3 inches and the MVTR at room temperature of 72° F. was 760 gm/m$^2$/day.

More than one and one-half pints of moisture could be transpired through each square meter of a housewrap per day at a 50% difference in relative humidity at 70° F.

Another sample was prepared using the same materials and process as above but using a substrate comprised of 44 gsy polyester fibers Lutradur® VP 230, manufactured by Freudenburg Spunweb. 18 gsy of the clay-latex formulation was applied to the substrate and reduced the FAP from 160 cu.ft./ft$^2$/min. to zero. This sample formed a strong, non-tearable breathable barrier fabric.

Figure 5:
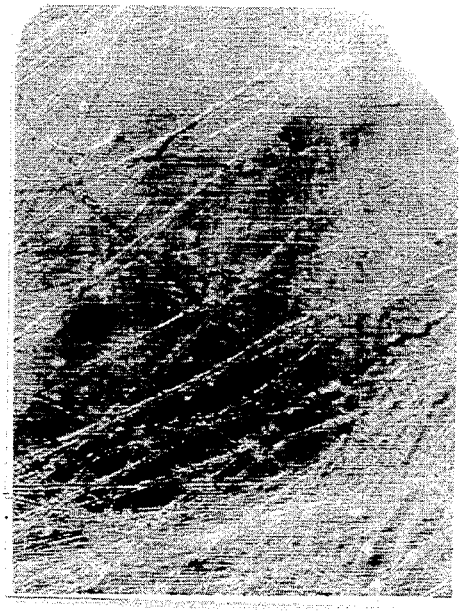
FIG. 5 is a photomicrograph at 11×of a nonporous barrier fabric made with a spunbond Lutrasil® substrate in accordance with Example IV.

FIG. 5 is a photomicrograph at 11×, of a barrier fabric of the invention, comprised of a 34 gsy Lutrasil® substrate, produced in accordance with the process of Example V. The solid nature of the fully filled fiber web is shown in the photomicrograph as well as the straightness and continuity of the spunbond fibers.

The 3F process is one in which both sides of a substrate fabric are fully filled with the film-forming filler material such that the filler material is sized into the void spaces between the fibers to form a solid nonporous layer. The substrate surface is scraped to remove the excess sizing material. The film-forming filler material is applied to the fabric by dipping the fabric in a trough containing an aqueous solution of the filler material. The fabric is held below the solution surface by a turning roll. As the fabric leaves the bath, two sharp knife edges contact the fabric surface, one on either side. The angles of contact are adjustable.

In an alternative application, the "two knives" are the edges of a slot cut into a metal or plastic plate. By rotating the plate, the degree of scraping action applied to the fabric threaded through the slot can be altered on both sides simultaneously.

EXAMPLE V

Barrier fabrics were produced which possessed a hydrostatic head above the specification for a "liquid proof" fabric and showed permeability to water vapor.

The clay-latex formulation used in Example IV was applied to a 40 gsy hydroentangled polyester fabric pre-treated with the fluorocarbon solution of Example I. Specifically, 107 grams of the clay dispersion from Example I were added to 43 grams of water and 150 grams of Reichhold's 40-434-00 51% solids latex. Additional water, 20 grams, was added to decrease the viscosity of the formulation which was then applied via a hand-held sizing blade to the substrate surface.

At a weight of 126 gsy, the hydrostatic head exceeded the limits of the test apparatus of 34 inches. This test value was corrected by a 0.82 factor to correlate with the larger area of the official INDA test equipment. Thus, the hydrostatic head was greater than 28 inches or 71 cm. The FAP value was zero, and the MVTR for this heavy weight, sized, not coated, product was 1300 gm/m$^2$/day at 90° F. Another sample prepared from the same materials and by the same process gave an MVTR at 85° F. of 1000 gm/m$^2$/day.

EXAMPLE VI

Barrier fabrics of the invention were prepared using a clay-latex formulation including the addition of sodium bicarbonate which increased the MVTR of the resulting barrier fabrics.

An amount, 4.7 grams, of a 7% sodium bicarbonate solution (i.e. 0.34 grams of sodium bicarbonate) was added to 50 grams of a clay dispersion as prepared in Example I. The dispersion flocculated. Addition of 50 grams of Reichhold's 40-434-00 51% solids latex thickened the mix which became smooth upon mixing. This clay-latex formulation was applied to a hydroentangled polyester fabric which was pre-treated with the fluorocarbon formulation of Example I. The MVTR at 85° F. of 101 gsy of the treated fabric was 1,400 gm/m$^2$/day and had a hydrostatic head greater than 28 inches. In comparison the sample from Example V containing no sodium bicarbonate had an MVTR at 85° F. of only 1,000 gm/m$^2$/day.

Another sample, using the same materials and process steps as above, was prepared using a clay-latex formulation containing 2.2 grams of sodium bicarbonate. This yielded a 99 gsy fabric with a MVTR at 85° F. of 1500 gm/m$^2$/day. A section at 85 gsy still possessed a "liquid proof" hydrostatic head, i.e. 25 to 30 inches.

Another sample was produced using the same materials and process steps as above, but with the addition of 1.4 grams of sodium bicarbonate added as a 7.7% solution. The resulting fabric weight was 98 gsy and the hydrostatic head was greater than 28 inches. The FAP test was performed at a pressure differential of 0.5 inches of water and was zero. The Gurley Densometer was 1700 sec. under a pressure of the heavy cylinder and 2300 sec. under a pressure of the lighter cylinder (this pressure is similar to that subjected to under the Frazier test). The Gurley Densometer readings were obtained for the fabric under the heavy cylinder by passing 100 cc of air through the fabric under a pressure of 4.88 inches of water and for the fabric under the lighter cylinder by passing under a pressure of 1.22 inches of water.

Another sample was prepared by adding 12 grams of titanium dioxide powder to 200 grams of the clay dispersion as prepared in Example I. This created a white product. The titanium dioxide dispersed well in solution and 200 grams of Reichhold's 40-434-00 51% solids latex and 10 grams of sodium bicarbonate in 106 grams of water was added. The solution was applied to same substrate as in Example I to produce a 112 gsy fabric. The MVTR of this sample at 85° F. was 1,650 gm/m$^2$/day, and the hydrostatic head was 28 inches.

Table III below, lists the effect of the addition of sodium bicarbonate in the clay-latex formulation on the MVTR of the barrier fabrics of the invention. As illustrated, the addition of titanium dioxide into the clay latex formulation further enhanced the breathing properties of the resulting fabric.

TABLE III

EFFECT OF SODIUM BICARBONATE ON THE MVTR

| % SODIUM BICARBONATE/ CLAY DISPERSION | MVTR gm/m$^2$/day |
|---|---|
| 0 | 1000 |
| 0.68 | 1400 |
| 2.8 | 1500 |
| 4.4 | 1500 |
| 4.0 (w/$TiO_2$) | 1650 |

Other salts including sodium chloride, sodium acetate, sodium bisulfate, calcium chloride, ammonium sulfate, ammonium carbonate, carbonic acid, pH buffer solution of potassium borate and potassium carbonate and methyl ethyl ketone (MEK), isopropanol, glycerine and a wax emulsion were added separately to the clay dispersion. All these compounds destabilized the clay dispersion. However, none produced a fluid formulation which increased the MVTR of the resulting barrier fabrics.

EXAMPLE VII

In this example, a preferred embodiment of a barrier fabric of the invention was produced. The following clay-latex formulation was run on a standard pilot plant finishing line consisting of a knife coater and a tenter-framed oven with unwind and wind stands:

40 lbs of a mixture of the clay dispersion as in Example I plus 2000 grams of 7% sodium bicarbonate; and 40 lbs of Reichhold's 40-434-00 51% solids latex.

This formulation was applied from the coater's trough onto a hydroentangled fabric which had been pre-treated with the fluorocarbon-wax-antistat solution of Example I. The speed on the line was 12 ft./min. and the oven temperature was 300 ° F.

The resulting product's hydrostatic head was greater than 28 inches at 126 gsy; 26.2 inches at 108 gsy; but only 13 inches at 98 gsy. The MVTR at 85° F. for 108 gsy was 1970 gm/m$^2$/day, which is significantly higher than the samples made on the lab bench. For the 126 gsy sample, the MVTR was 1440 gm/m$^2$/day with a hydrostatic head greater than 29 inches.

EXAMPLE VIII

In this example the effect of temperature on the MVTR of the barrier fabrics of the invention is shown. The product of Example VII, above, was tested for MVTR as a function of temperature.

Figure 6:
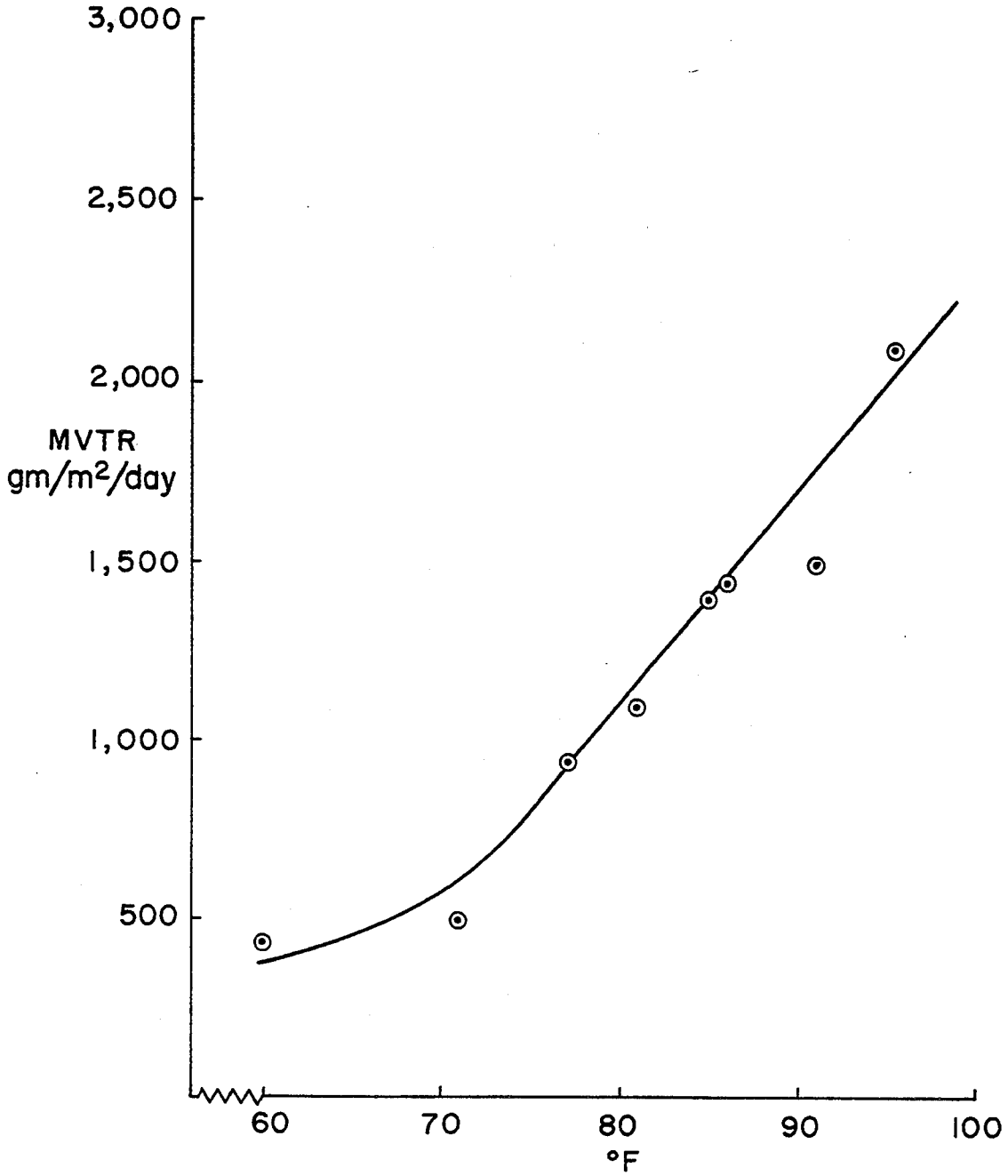
FIG. 6 is a graphic illustration showing the effect of temperature on the MVTR of the barrier fabrics of the invention in accordance with Example VIII.

The sample tested weighed 114 gsy and had a FAP value of zero. The temperature and MVTR data of this sample is shown in FIG. 6 and listed below in TABLE IV.

TABLE IV

EFFECT OF TEMPERATURE ON THE MVTR

| TEMPERATURE °F. | MVTR gm/m$^2$/24 hrs. |
|---|---|
| 62 | 450 |
| 71 | 500 |
| 77 | 900 |
| 81 | 1100 |
| 85 | 1400 |
| 86 | 1450 |
| 91 | 1500 |
| 95.5 | 2100 |

As shown in FIG.6, the slope of the curve plotted from these data shows that between 75° F. and 95° F. the MVTR increases by 60 gm/m$^2$/day for each degree rise in temperature. This means that two fluid ounces more of moisture would be transpired through each square meter of fabric per day, per degree rise in temperature. In the case of a coverall, it means that an extra 10 oz. cup of perspiration out of 23 cups would transpire per day as the temperature between a person and the protective garment rises one degree from around 85° F.

EXAMPLE IX

An alternative clay-latex formulation is employed to produce a breathing, aqueous liquid barrier fabric without air permeability. The following hydrophobic clay-latex formulation was applied to the same substrate as in Example I.

| Component | % Wet |
|---|---|
| Clay dispersion | 40.0 |
| National Starch NS6272 | 44.0 |
| Polystep F-9 | 0.7 |
| Graphtol Blue Pigment 6825-2 | 1.4 |
| Black Shield Color CD1103-96 | 1.0 |
| Ammonium Stearate | 9.5 |
| Fluorocarbon FC824 | 2.7 |
| Siligen APE | 0.6 |
| Aerotex 96B | 0.9 |
| | 100.8 |

The viscosity of the clay-latex formulation was 1500 to 2200 cps and the density 1100 gm/liter. A single application of 35 gsy of the formulation decreased the FAP to 7 cu.ft./sq. ft./min. Accordingly, a second pass was made to add another 19 gsy of the formulation to the substrate, bringing the total weight to 92 gsy and the FAP to zero. This resulting product had an MVTR at 86° F. of 1500 gm/m$^2$/day and a hydrostatic head value of 9 to 10 inches. The fabric produced was very soft with outstanding drape.

In another embodiment, the substrate fabric was presized with undiluted hydrophobic, blue colored latex, i.e. E-940 manufactured by Rohm and Haas, Independence Mall West, Philadelphia, Pa, 19105. After drying and application of the above grey mixture on the fabric surface a two-toned fabric with a FAP value of zero resulted. Its MVTR at 86° F. was only 700 gm/m$^2$/day.

In order to thicken the pre-size for lower add-on and to increase the MVTR, air was mixed into the E940 latex and clay was added. To stabilize the air, 6 grams of ammonium stearate was added to 200 grams of the clay dispersion from Example I. The resulting clay-latex formulation had a density of 430 gm/l. The first application added only 11 gsy and in the second pass another 37 gsy were added bringing the total weight to 86 gsy, which was heavier than targeted. Even so, the MVTR at 87° F. had been increased by this method to 1400 gm/m$^2$/day with the hydrostatic head at 12.3 inches (31 cm).

The air permeability of the first pass product was high at 300 cu. ft./sq. ft./min. due to the introduction of air into the E-940 precoat and its low add-on.

In another experiment, the formulation based on NS6272 as listed above was used after it had been air-thickened to 580 gm/l to pre-size the fluorocarbon pretreated HEF. The air permeability was lowered to 170 cu. ft./sq. ft./min. Subsequently, the same compound without air at 1,100 gm/l density was applied to reduce the FAP to zero at 75 gsy. The MVTR at 87° F. was 2,200 gm/m$^2$/day, which is higher than for other samples. The hydrostatic head was 10 to 12 inches.

At room temperature, 71° F., the MVTR was 700 gm/m$^2$/day.

EXAMPLE X

Barrier fabrics are produced using a clay-latex formulation which has been air thickened to create fabrics having high FAP and MVTR values.

As shown in Example IX, the use of an air-thickened pre-size formulation can be used in the invention process to create a barrier fabric having a high FAP value. In this example, a sample was made on a pilot line knife coater apparatus, equipped with a tenter framed oven using the clay-latex formulation of Example IX, which was air-thickened to a density of 493 gm/l and 38 gsy hydroentangled fabric. The formulation was applied to the web and produced a soft fabric having an FAP of 130 cu. ft./sq. ft./min. at 57 gsy.

Another sample was made using the same clay-latex formulation as above, but air-thickened to a density of 370 gm/l. This mixture created a 61 gsy barrier fabric with a hydrostatic head of 10 inches and an FAP of 65 cu. ft./sq. ft./min. The barrier fabric was water-repellant and possessed a comfortable feel. The MVTR at 85° F. was approximately 2500 gm/m$^2$/day.

The same clay-latex formulation was air-thickened to a density of 375 gm/l and then applied by the pilot plant machine at 45 feet per minute to a 35 gsy polypropylene spunbond substrate. A 61 gsy barrier fabric with a FAP equal to 45 cu. ft./sq. ft./min. was attained. At 55 gsy the FAP value was 88 cu. ft./sq. ft./min. with a hydrostatic head of 7 inches.

Table V below lists the physical characteristics of the barrier fabrics made in accordance with the invention, and in particular according to the nonporous barrier fabrics of Example VI. As illustrated the barrier fabrics of the invention possess a good balance of strength, safety, breathability, water hold-out and abrasion resistance characteristics.

TABLE V

PHYSICAL CHARACTERISTICS OF NONPOROUS BARRIER FABRICS

| PHYSICAL PROPERTY | EXAMPLE VI | TARGET OR SPECIFICATION |
|---|---|---|
| WEIGHT, gsy | 111 | <140 |
| MVTR, gm/m$^2$/24 hr. | 1,500 at 85° F. | >936 to 1560 or more |
| CALIPER, mils (Ames at 0.08 psi) | 19 | — |
| FRAZIER AIR PERMEABILITY cu. ft./sq. ft./min. | 0 | 0 |
| GURLEY POROSITY (sec./100 cc) | 2,300 | >1500 |
| MULLEN BURST, psi | 50 | >35 |
| HYDROSTATIC HEAD, cm | >71 | >60 |

TABLE V-continued

| PHYSICAL CHARACTERISTICS OF NONPOROUS BARRIER FABRICS | | |
|---|---|---|
| PHYSICAL PROPERTY | EXAMPLE VI | TARGET OR SPECIFICATION |
| WATER IMPACT, gm through | 0.02 | <5.0 |
| CENCO ABRASION, cycles | 735 | >200 |
| TENSILE STRENGTH Instron (lb./in.) | | |
| MD | 40 | >20 |
| CD | 31 | >15 |
| ELONGATION, % | | |
| MD | 57 | 80 |
| CD | 96 | 120 |
| STATIC DECAY, sec | | |
| MD | 0.04 | <0.5 |
| CD | 0.09 | <0.5 |
| NFPA 702 (45° angle) | Does not burn | >3 sec. |

Figure 7:
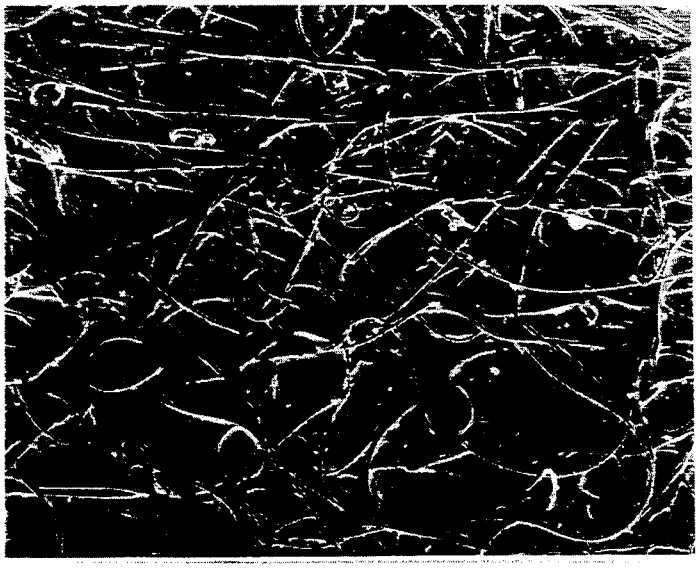
FIGS. 7–9 are photomicrographs of the barrier fabric, respectively at 50×, 100× and 500× magnification, in accordance with Example V.
Figure 8:
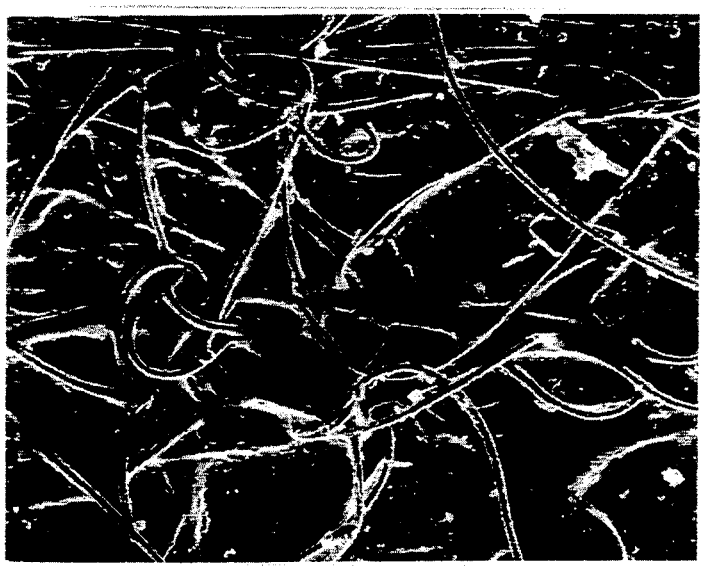
Figure 9:
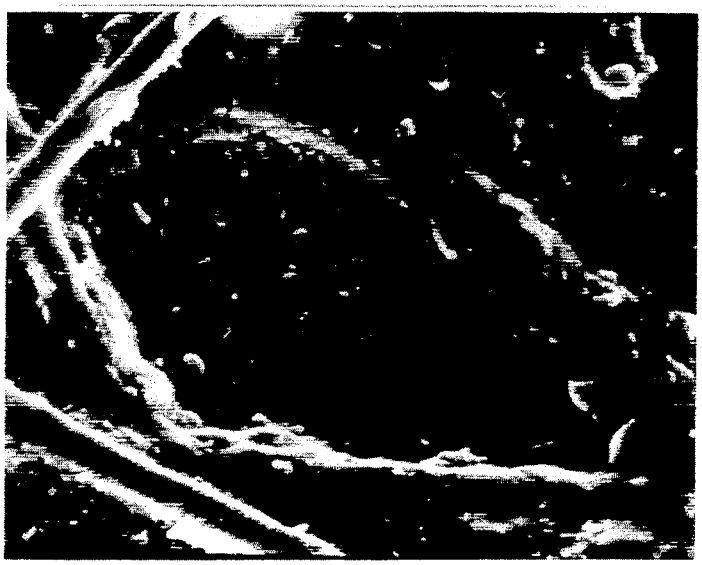

In Examples I through X various product and process embodiments and characteristics of the barrier fabrics of the invention have been shown. In general, breathable barrier fabrics which are permeable to water vapor and impermeable to air and aqueous liquids are provided by sizing a substrate on one or both sides with a film-forming filler material. This material forms a continuous film of polymer between the substrate fibers to form the nonporous but breathing barrier fabric. In FIGS. 7, 8 and 9, photomicrographs at 50×, 100× and 500×, respectively, of the barrier fabrics produced in accordance with Examples V and VI are shown. The photomicrographs show the solid nature of the film between the fibers and the exposure of the fibers near the fabric surface which give the resulting fabric a good tactile quality.

Additionally air can be introduced in the film-forming filler material to create barrier fabrics which are permeable to air and water vapor but impermeable to aqueous liquids.

Advantageously, the method for producing the breathable barrier fabrics of the invention is less complex to manufacture than the production of barrier fabrics comprised of laminates of plastic films. The barrier fabrics of the invention are integral structures, with a surface of textile tactile quality, that will not delaminate. The invention materials are also less costly than plastic or fluorocarbon polymeric films used in other barrier fabrics known in the prior art.

In addition, the utilization of conventional process lines and the elimination of the use of microporous films provide low cost, drapable barrier fabrics. The process of the invention creates non-tearing, light weight, breathable barriers, which allow no inward air flow but permit temperature sensitive moisture vapor transpiration.

It will be recognized by those skilled in the art that the invention and process have wide application in the production of protective industrial outerwear, clean room coveralls, lab coats, hospital gowns, or drapes, house wraps, bandages and other uses. The fabric is an effective barrier against airborne or aqueous bacteria and contaminants, such as the AIDS virus or asbestos.

Finally, variations of the fiber compositions and the clay-latex formulation materials from the examples given herein are possible in view of the above disclosure. Therefore, although the invention has been described with reference to certain preferred embodiments, it will be appreciated that other composite structures and processes for their fabrication may be devised, which are nevertheless within the scope and spirit of the invention as defined in the claims appended hereto.

I claim:

1. A breathable barrier fabric comprising:

a substrate, including fibers which define void spaces therein, with a film-forming clay-latex filler material sized throughout said substrate to fill said void spaces and form a continuous solid non-porous film between said fibers;

said clay-latex filler material having a density in the approximate range of 1,000 to 2,000 gm/l;

such that the barrier fabric is permeable to water vapor and impermeable to aqueous liquids and air and has a Moisture Vapor Transmission Rate in the range of 300 to 3,000 gm/m$^2$/day.

2. The breathable barrier fabric as defined in claim 1, wherein the Frazier Air Permeability is zero.

3. The breathable barrier fabric as defined in claim 1, wherein said substrate is a woven or nonwoven fabric.

4. The breathable barrier fabric as defined in claim 3, wherein said nonwoven fabric has fiber lengths in the range of 1.0 to 2.0 inches and deniers in the range of 1.0 to 3.0.

5. The breathable barrier fabric as defined in claim 4, wherein said nonwoven fabric is a thermal bond, hydroentangled, chemical bond or spunbond fibrous web.

6. The breathable barrier fabric as defined in claim 1, wherein said void spaces are in the range of 0.05 mm to 0.4 mm and are equivalent to the interstitial distances between said fibers.

7. The breathable barrier fabric as defined in claim 1, wherein said film-forming clay-latex filler material is an aqueous clay-latex formulation that permits diffusion of water vapor.

8. The breathable barrier fabric as defined in claim 1, wherein said film-forming clay-latex filler material comprises film-forming latexes and clays having a density in the range of 1,000 to 2,000 gm/l.

9. The breathable barrier fabric as defined in claim 1, wherein said film-forming clay-latex filler material is comprised of silicates and any type of polymeric latexes.

10. The breathable barrier fabric as defined in claim 1, wherein sodium bicarbonate is added to said film-forming clay-latex filler material to increase water vapor permeability of the breathable fabric.

11. The breathable barrier fabric as defined in claim 1, wherein said film-forming clay-latex filler material is sized into both surfaces of said substrate.

12. A breathable barrier comprising:

a substrate, including fibers which define void spaces therein, with a film-forming clay-latex filler material sized throughout said substrate to fill said void spaces and form a continuous film between said fibers;

wherein air is dispersed into said film-forming clay-latex filler material and has a density in the range of 300 to 500 gm/l.;

such that the barrier fabric is permeable to water vapor and impermeable to aqueous liquids and has a Moisture Vapor Transmission Rate in the range of 300 to 3,000 gm/m$^2$/day.

13. The breathable barrier fabric as defined in claim 12, wherein said continuous film between said fibers is porous and permits diffusion of water vapor and air.

14. The breathable barrier fabric as defined in claim 12, wherein the Frazier Air Permeability is in the range of 25–400 cu. ft./sq. ft./min.

* * * * *